US010458090B2

(12) United States Patent
Raposo et al.

(10) Patent No.: US 10,458,090 B2
(45) Date of Patent: Oct. 29, 2019

(54) SOIL DISPLACEMENT PILES

(71) Applicant: Hubbell Power Systems, Inc., Columbia, SC (US)

(72) Inventors: Alex Joseph Raposo, Long Branch, NJ (US); Matthew Alan Conte, Bridgeport, CT (US); Gary Leonard Seider, Centralia, MO (US); Timothy Michael Kemp, Columbia, MO (US); Shawn David Downey, Columbia, MO (US)

(73) Assignee: HUBBELL POWER SYSTEMS, INC., Columbia, SC (US)

( * ) Notice: Subject to any disclaimer, the term of this patent is extended or adjusted under 35 U.S.C. 154(b) by 0 days.

(21) Appl. No.: 15/346,672

(22) Filed: Nov. 8, 2016

(65) Prior Publication Data

US 2017/0218590 A1 Aug. 3, 2017

Related U.S. Application Data

(60) Provisional application No. 62/290,637, filed on Feb. 3, 2016.

(51) Int. Cl.
*E02D 5/56* (2006.01)
*E02D 5/28* (2006.01)
(Continued)

(52) U.S. Cl.
CPC ..... *E02D 5/56* (2013.01); *E02D 5/00* (2013.01); *E02D 5/34* (2013.01);
(Continued)

(58) Field of Classification Search
CPC .. E02D 5/56; E02D 5/801; E02D 7/22; E02C 7/22
(Continued)

(56) References Cited

U.S. PATENT DOCUMENTS 153,807 A * 8/1874 Collins ..... E21B 10/44 135/118
2,613,062 A * 10/1952 Harbert ..... E21B 10/44 175/323
(Continued)

FOREIGN PATENT DOCUMENTS

DE 3314125 10/1984
JP 2001040662 2/2001
(Continued)

OTHER PUBLICATIONS

International Search Report and Written Opinion mailed in corresponding application PCT/US2016/061010 dated Jan. 25, 2017 (12 pages).

*Primary Examiner* — Frederick L Lagman
*Assistant Examiner* — Stacy N Lawson
(74) *Attorney, Agent, or Firm* — Wissing Miller LLP

(57) ABSTRACT

Soil displacement piles having a shaft and one or more soil displacement assemblies secured to the shaft are provided. If more than one soil displacement assembly is utilized, each soil displacement assembly is separated by a longitudinal distance. Each soil displacement assembly has an upper helical plate, a lower helical plate separated from the upper helical plate by a longitudinal plate distance, and at least one soil displacement plate positioned relative to the shaft, the upper helical plate and the lower helical plate.

16 Claims, 10 Drawing Sheets

(51) Int. Cl.
*E02D 5/00* (2006.01)
*E02D 5/34* (2006.01)

(52) U.S. Cl.
CPC ..... *E02D 2250/0023* (2013.01); *E02D 2250/0038* (2013.01); *E02D 2300/0018* (2013.01)

(58) Field of Classification Search
USPC ..... 405/231, 249, 252.1, 253; 175/394; 52/157
See application file for complete search history.

(56) References Cited

U.S. PATENT DOCUMENTS 3,382,937 A * 5/1968 Watts ..... E21B 17/22 175/323
4,623,025 A 11/1986 Verstraseten
5,252,009 A 10/1993 Bossler
5,707,180 A 1/1998 Vickars et al.
5,722,498 A 3/1998 Van Impe et al.
6,082,472 A 7/2000 Verstraeten
6,264,402 B1 7/2001 Vickars et al.
6,722,821 B1 * 4/2004 Perko ..... E02D 5/801 405/249
6,834,733 B1 12/2004 Maouche et al.
7,040,842 B2 5/2006 Stotzer
7,241,079 B2 7/2007 Francis
7,494,299 B1 2/2009 Whitsett
7,571,781 B2 8/2009 Stoetzer
7,748,932 B2 7/2010 Lindsey
7,854,451 B2 * 12/2010 Davis, II ..... E21B 17/046 285/404
8,033,757 B2 10/2011 Stroyer
8,845,236 B1 * 9/2014 Dosdourian ..... E02D 5/801 175/19
9,416,513 B2 8/2016 Kemp et al.
9,422,741 B1 * 8/2016 Conte ..... E04H 17/22
2002/0150430 A1 10/2002 Vickars et al.
2006/0013656 A1 * 1/2006 Blum ..... E02D 5/36 405/241
2008/0302028 A1 12/2008 Lewenhoff
2010/0054864 A1 * 3/2010 Stroyer ..... E02D 5/56 405/233
2010/0263928 A1 * 10/2010 Massari ..... E02D 5/36 175/19
2012/0087740 A1 4/2012 Stroyer
2013/0343823 A1 12/2013 Lin
2014/0286712 A1 * 9/2014 Lutenegger ..... E02D 5/56 405/252.1
2015/0117960 A1 4/2015 Kenp et al.

FOREIGN PATENT DOCUMENTS

JP 2010222853 10/2010
JP 2012067562 A * 4/2012
JP 2012077537 4/2012

* cited by examiner

Fig. 12
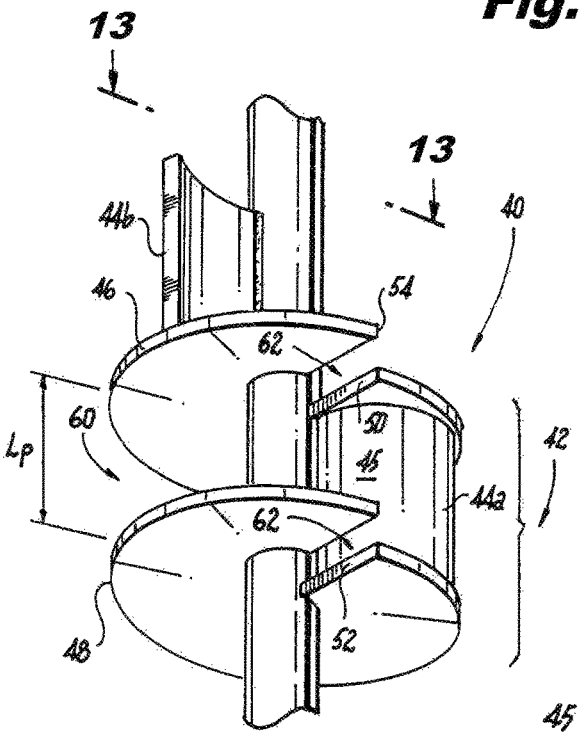
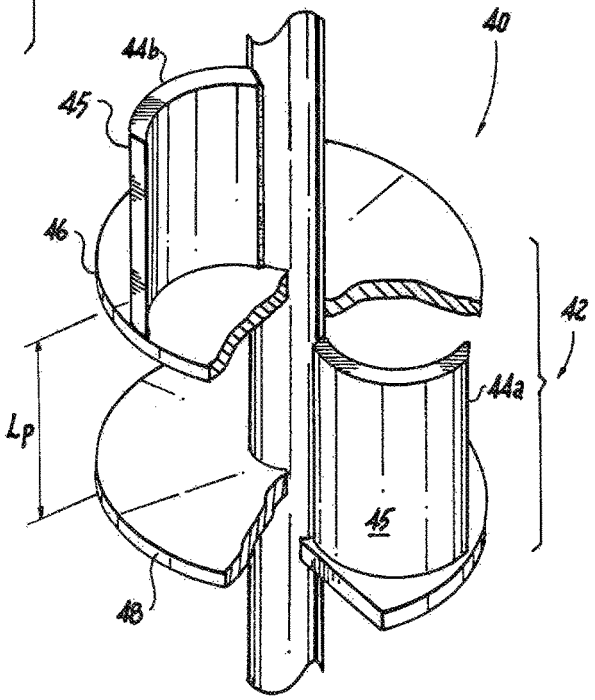
Fig. 13

SOIL DISPLACEMENT PILES

CROSS-REFERENCE TO RELATED APPLICATIONS

The present application claims priority to U.S. Provisional Application No. 62/290,637 filed on Feb. 3, 2016, entitled "Helical Soil Displacement Pier Used for Forming Grouted Piles in Place" which is incorporated herein in its entirety by reference.

BACKGROUND

Field

The present disclosure relates in general to pile leads and extensions with soil displacement assemblies for forming composite pile columns.

Description of the Related Art

Piles are often required to be placed into the ground for providing support for foundations or other structures. It is desirable to install such piles quickly and efficiently so as to reduce construction costs. Often it is beneficial to form the piles in place, i.e., at the job site. One conventional method for forming piles at the job site involves inserting a flat disk on a shaft down through the soil by turning a screw at a lower end of a shaft. The disk clears a cylindrical region around the shaft. The cylindrical region is filled with grout to encapsulate the shaft. Another conventional method for forming piles at the job site involves placing a helical pile that appears to have an elongated pipe with a central chamber in the soil. The pipe has a helical blade with an opening in the trailing edge of the blade where grout is extruded. The grout fills the portions of the soil disturbed by the blade. The present disclosure provides a new system to form pile columns at the job site.

SUMMARY

The present disclosure provides descriptions of soil displacement assemblies that are attached to helical pile leads and/or extensions and used to form composite pile columns at the job site. In one exemplary configuration, the soil displacement assembly comprises an upper helical plate, a lower helical plate, and at least one soil displacement plate having a soil contacting surface positioned between the upper helical plate and the lower helical plate and attached to the upper helical plate and the lower helical plate.

The present disclosure also provides descriptions of soil displacement piles having one or more soil displacement assemblies that are used to form composite pile columns at the job site. In one exemplary configuration, the soil displacement pile comprises a lead and at least one extension. The lead has a lead shaft, and at least one lead soil displacement assembly attached at least partially to the lead shaft. The at least one extension has an extension shaft, and at least one extension soil displacement assembly attached to the extension shaft. In another exemplary configuration, the soil displacement pile comprises a shaft, and a plurality of soil displacement assemblies secured to the shaft and separated by a longitudinal distance.

BRIEF DESCRIPTION OF THE DRAWINGS

The figures depict configurations for purposes of illustration only. One skilled in the art will readily recognize from the following description that alternative configurations of the structures illustrated herein may be employed without departing from the principles described herein, wherein:

FIG. 12 is a bottom perspective view of another exemplary configuration of a soil displacement assembly according to the present disclosure;

FIG. 13 is a top perspective view of the soil displacement assembly of FIG. 12;

DETAILED DESCRIPTION

The present disclosure provides configurations of pile leads and extensions with soil displacement assemblies that facilitate the formation of grout, concrete or cement based pile columns. The soil displacement assemblies push the soil so as to displace the soil radially outwardly away from a shaft of the soil displacement pile lead and any extensions to form a cavity in which grout, cement or concrete can be poured to at least partially surround the pile leads and any extensions. The cured grout, cement or concrete with the embedded pile form a composite pile column. For ease of description the word "filler" is used when describing the material being poured into the cavity. The filler may include grout, cement, concrete or other suitable material that can be poured into the cavity and hardened to form the composite pile column.

Figure 1:
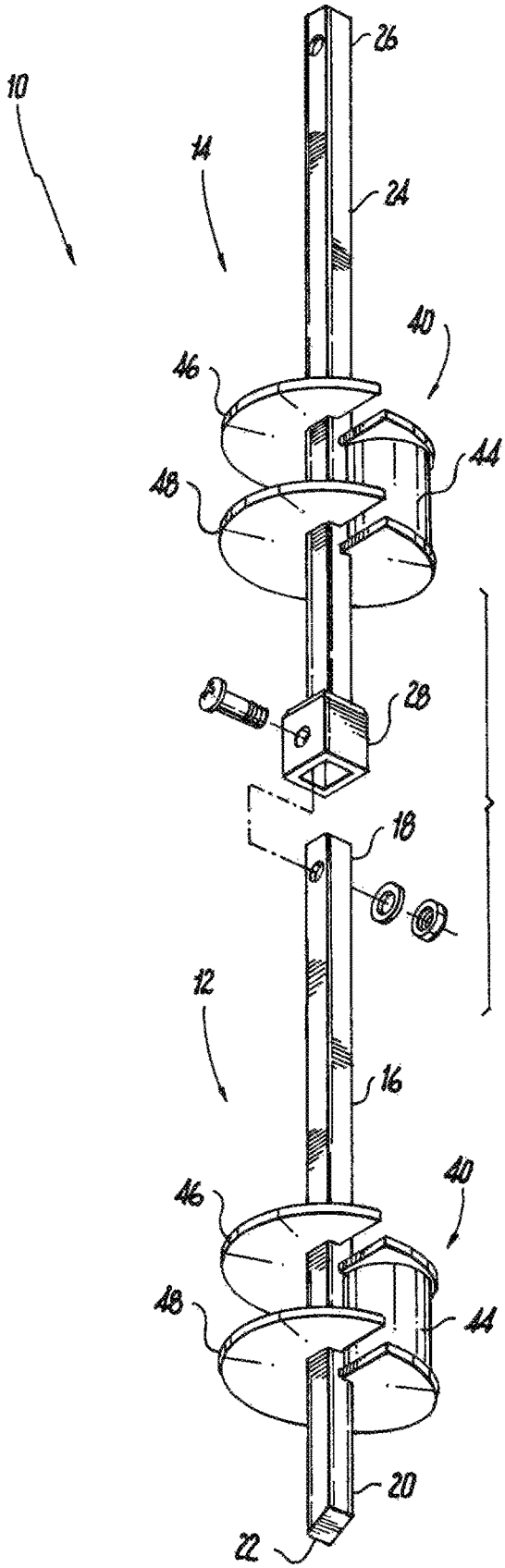
FIG. 1 is a bottom perspective view of an exemplary configuration of a soil displacement pile having a lead and extension each having a soil displacement assembly according to the present disclosure.

Referring to FIG. 1, an exemplary configuration of a soil displacement pile according to the present disclosure is shown. The soil displacement pile 10 has a lead 12 and possibly one or more extensions 14. The lead 12 comprises a square or round shaft or pipe 16 and at least one soil displacement assembly 40. The lead shaft 16, which is the bottom most shaft of a soil displacement pile 10, has a lead head portion 18 and a lead end portion 20. The lead end portion 20 is configured to first penetrate the soil, and terminates at its distal end with a tapered tip 22. Each of the one or more extensions 14 comprises a square or round shaft or pipe 24 and at least one soil displacement assembly 40. Each extension shaft 24 has extension head portion 26 and an extension end portion 28. The first extension added to the soil displacement pile 10 is secured to the lead 12 where the extension end portion 28 is mated with the lead head portion 18 using one or more nut and bolt. Subsequent extensions may be sequentially joined together where the extension end portion 28 of the next in line extension 14 is mated with the extension head portion 26 of the previous extension 14 using one or more nut and bolt. The lead shaft 16 and the extension shaft 24 can be hollow or solid, and the shafts 16 and 24 can be made of metal, e.g., steel or galvanized steel, or carbon fiber, or other suitable material known in the art.

As noted, the extensions 14 are optional such that the lead 12 may comprise the soil displacement pile 10 and a pile drive system head is used to rotate the lead 12 into the soil. If one or more extensions 14 are added to the lead 12 then the lead and the one or more extensions form the soil displacement pile 10, and the pile drive system head is used to first rotate the lead 12 into the soil and then each extension successively into the soil.

Figure 2:
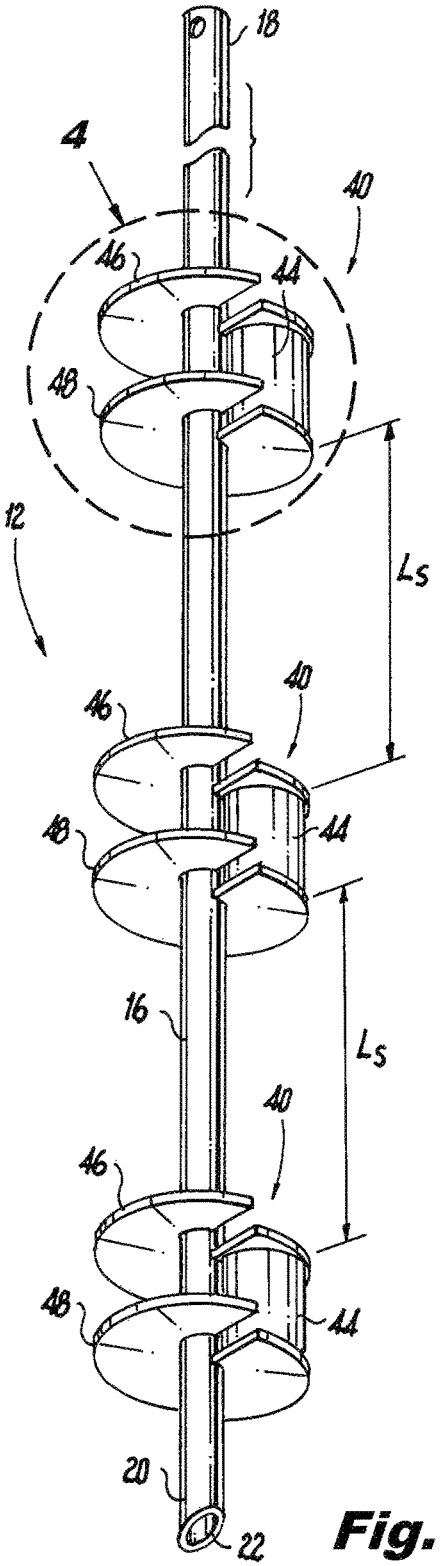
FIG. 2 is a bottom perspective view of an exemplary configuration of a soil displacement pile lead having a plurality of soil displacement assemblies according to the present disclosure.

As noted, the lead 12 and extensions 14 according to the present disclosure include one or more soil displacement assemblies 40 secured directly or indirectly to the lead shaft 16 and/or the extension shaft 24. Securing the soil displacement assemblies 40 directly to the lead shaft 16 and/or the extension shaft 24 includes a direct connection between the respective shaft and the soil displacement assembly, such as by welding or mechanical fasteners. Securing the soil displacement assemblies 40 indirectly to the lead shaft 16 and/or the extension shaft 24 includes an indirect connection between the respective shaft and the soil displacement assembly, such as by using a coupler to join the respective shaft and the soil displacement assembly and securing the coupler to the shaft, or by mating the soil displacement assembly with a coupling already on the respective shaft. In the configuration of FIG. 1, the lead 12 has one soil displacement assembly 40 and the extension 14 has one soil displacement assembly 40. In the configuration of FIG. 2, the lead 12 has three soil displacement assemblies 40 spaced along the length of the shaft with a longitudinal distance "Ls" between each soil displacement assembly. The longitudinal distance "Ls" between the soil displacement assemblies may be in the range from about 3 feet to about 10 feet. Similarly, in the configuration of FIG. 3, the lead 12 has three soil displacement assemblies 40 spaced along the length of the shaft with a longitudinal distance "Ls" between each soil displacement assembly, and also includes one or more spaced apart load bearing helical plates 30 arranged on the lead shaft 16. The load bearing helical plate 30 is typically in the lead end portion 20 and separated from the lower soil displacement assembly 40 a distance "Lt". The spacing "Lt" between the load bearing helical plate 30 and the lower soil displacement assembly 40 may range from about 12 inches to about 24 inches. The load bearing helical plate 30 is provided to initially penetrate the soil and pull the soil displacement pile 10 downward when the lead shaft 16 is rotated.

Figure 3:
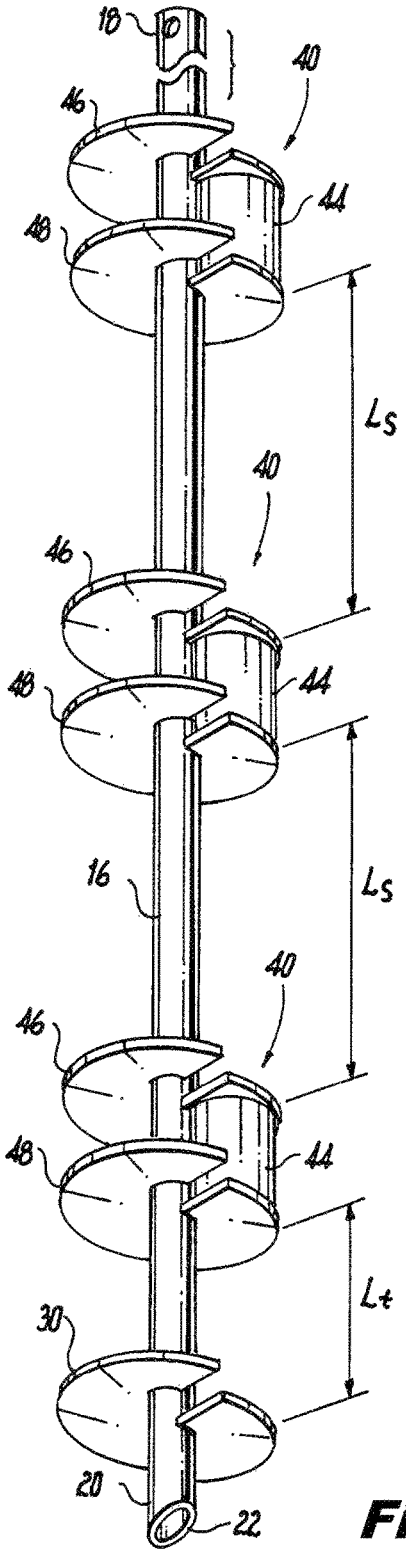
FIG. 3 is a bottom perspective view of another exemplary configuration of a soil displacement pile lead having a plurality of soil displacement assemblies and a load bearing helical plate at an end portion of the lead.

In the configuration of FIG. 3, the lead 12 has a single load bearing helical plate 30. In the event more than one load bearing helical plates 30 are secured to the lead shaft 16, the load bearing helical plates 30 may have the same diameter, or the load bearing helical plates 30 may have different diameters that are in, for example, a tapered arrangement. To illustrate a tapered arrangement, the smallest diameter load bearing helical plate 30 may be positioned closest to the tapered tip 22 of the lead shaft 16, and the largest load bearing helical plate 30 may be positioned at a distance away from the tapered tip 22. Such load bearing helical plates 30 on the lead shaft 16 may be spaced apart at a distance sufficient to promote plate load bearing capacity as is known in the art. The diameter of the load bearing helical plates 30 may range from between about 6 inches to about 16 inches depending upon the load the soil displacement pile 10 is to carry. The pitch of the load bearing helical plates is between about 2 inches and about 4 inches. For example, the pitch may be about 3 inches.

Figure 4:
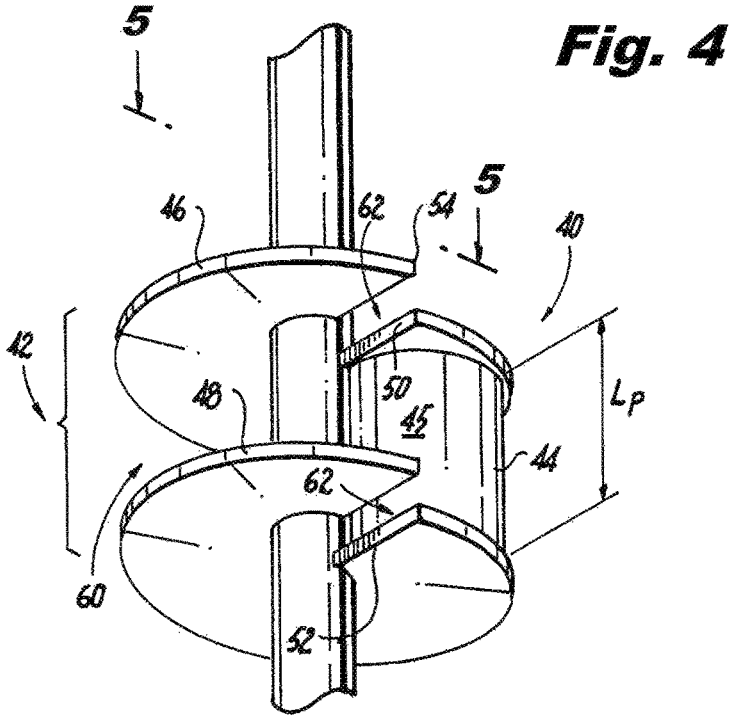
FIG. 4 is a bottom perspective view of an exemplary configuration of a soil displacement assembly according to the present disclosure.
Figure 5:
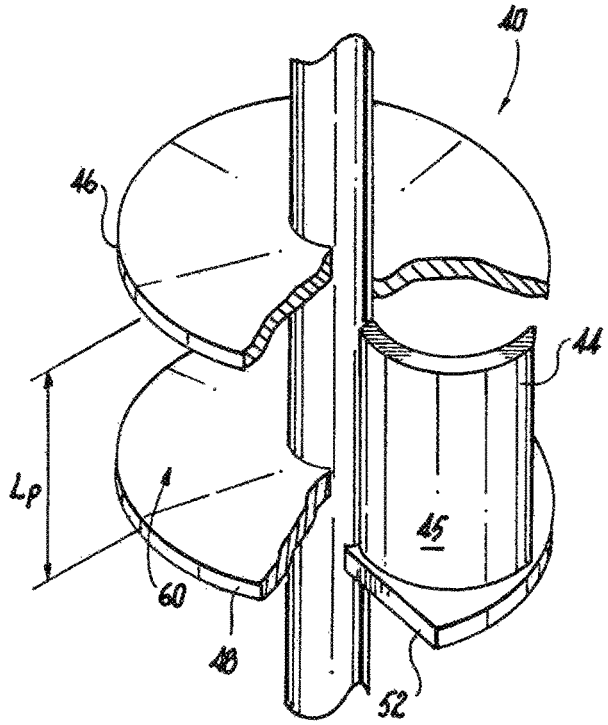
FIG. 5 is a top perspective view of the soil displacement assembly of FIG. 4 illustrating a pair of separated helical plates with a soil displacement plate between the helical plates.

Referring now to FIGS. 4-13, exemplary configurations of a soil displacement assemblies 40 according to the present disclosure are shown. Referring to FIGS. 4 and 5, the soil displacement assembly 40 includes, for example, a pair of helical plates 42 and at least one soil displacement plate 44. Each helical plate pair 42 comprises an upper helical plate 46 and a lower helical plate 48. The upper and lower helical plates 46 and 48 are separated by a longitudinal distance "Lp" creating a void 60 between the upper and lower helical plates. The distance "Lp" is based upon, for example, the helix pitch and diameter. The distance "Lp" can range from between about 6 inches to about 12 inches. Preferably, the longitudinal distance between the soil displacement assemblies "Ls" is greater than the longitudinal distance between the helical plate pair "Lp".

Figure 6:
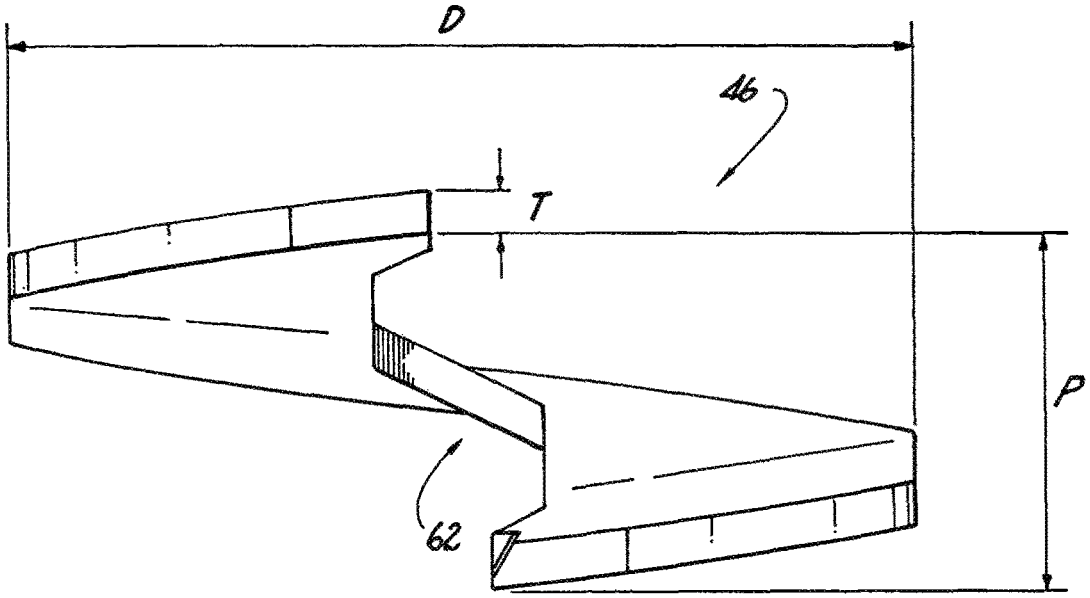
FIG. 6 is a side elevation view of an exemplary configuration of a helical plate used with the soil displacement assembly of the present disclosure.
Figure 11:
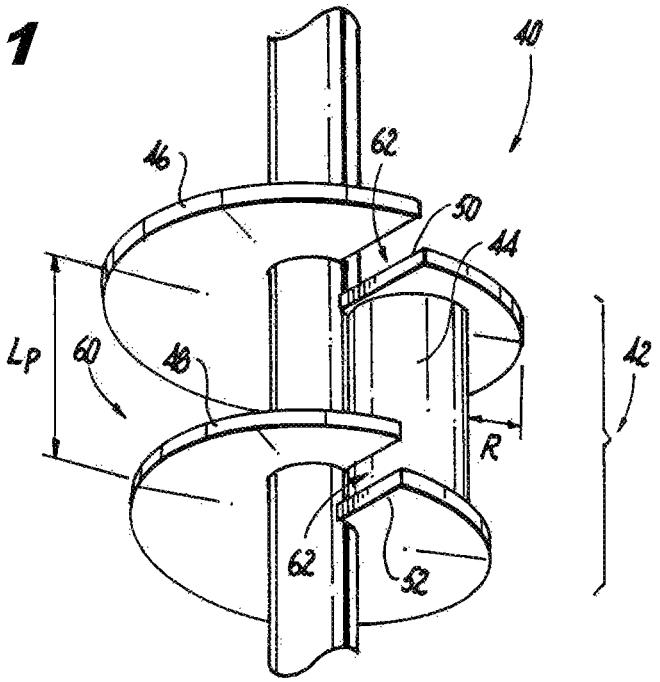
FIG. 11 is a bottom perspective view of another exemplary configuration of a soil displacement assembly according to the present disclosure, illustrating an upper helical plate having a larger diameter than a lower helical plate.

Referring to FIG. 6, the diameter "D" of the upper and lower helical plates 46 and 48 may range from between about 6 inches to about 16 inches depending upon the size of the cavity to be created by soil displacing assembly 40 and thus the size of the pile column created by the cured filler and soil displacement pile 10. The diameter "D" of the upper and lower helical plates 46 and 48 may be the same, as shown in FIG. 4, or they may differ, as shown in FIG. 11. More specifically, the upper helical plate 46 may have a diameter that is larger than the lower helical plate 48, or the upper helical plate 46 may have a diameter that is smaller than the lower helical plate 48. For example, the diameter of the upper helical plate 46 may be about 16 inches and the diameter of the lower helical plate 48 may be 6 inches. As another example, the diameter of the upper helical plate 46 may be about 8 inches and the diameter of the lower helical plate 48 may be 12 inches. The upper and lower helical plates 46 and 48 have a helical pitch "P" of between about 2 inches and about 4 inches. For example, the pitch may be about 3 inches. The pitch of the upper and lower helical plates 46 and 48 creates a gap 62 between the leading edge of each plate and the trailing edge of each plate. This gap 62 permits filler being poured into the cavity 70, seen in FIG. 14, created by the one or more soil displacement assemblies 40 to fill the void 60 between the upper and lower helical plates 46 and 48, and to permit filler to pass through the soil displacement assembly. The thickness "T" of each helical plate 46 and 48 may be between about ⅜ inch and about ¾ inch.

Referring again to FIGS. 4 and 5, positioned between the upper and lower helical plates 46 and 48 is the at least one soil displacement plate 44. In the configuration of FIGS. 4 and 5, one soil displacement plate 44 is positioned between the helical plates 46 and 48 and secured to the shaft 16 of the lead 12 or the shaft 24 of the extension 14 by, for example, welding or mechanical fasteners. The soil displacement plate 44 is also attached to each of the upper and lower helical plates 46 and 48 by, for example, welding or mechanical fasteners. Attaching the soil displacement plate 44 between the upper and lower helical plates 46 and 48 increases the strength of the soil displacement plate 44 facilitating displacement of the soil as described herein. Each soil displacement plate 44 has a soil contacting surface 45, and extends radially from the shaft 16 of the lead 12 or the shaft 24 of the extension 14 to an outer edge of each helical plate. Preferably, each soil displacement plate 44 is a curved plate, as shown in FIG. 5, and is secured to the helical plates 46 and 48 so that the soil displacement plate curves in a counterclockwise direction proceeding radially from the shaft 16 of the lead 12 or the shaft 24 of the extension 14 such that the soil contacting surface 45, here the convex surface, of the soil displacement plate 44 is positioned to contact and displace the soil to create the cavity 70 for forming the pile column 80. More specifically, as the helical plates 46 and 48 rotate clockwise the convex surface 45 of the soil displacement plate 44 contacts the soil and displaces it radially outward away from the shaft 16 of the lead 12 or away from the shaft 24 of the extension 14 creating the displaced soil cavity 70.

The soil displacement plate 44 may be secured to the lead shaft 12 or extension shaft 14 and the helical plates 46 and 48 anywhere along the helical plates. In the configuration shown in FIGS. 4 and 5, one end of the soil displacement plate 44 is positioned adjacent a leading edge 50 of the upper helical plate 46 and adjacent a leading edge 50 of the lower helical plate 48. The soil displacement plate 44 is illustrated in FIGS. 4 and 5 as having a soil contacting surface 45 over a relatively small circumferential portion of the upper and lower helical plates 46 and 48. However, the soil displacement plate 44 may have a soil contacting surface 45 that extends along a more substantial portion of the circumference of the upper and lower helical plates 46 and 48. More specifically, if the soil displacement plate has a curvature, the radius of the curvature of the soil displacement plate 44 may vary depending upon, for example, the type of soil to be encountered and the relative density of the soil to be encountered. The radius of the curvature of the soil displacement plate 44 may be in the range of about 30 degrees to about 180 degrees. In an alternative configuration, the soil contacting surface 45 may vary and may be irregular so long as the soil contacting surface 45 is capable of displacing soil outwardly as the soil displacement pile 10 is being rotated.

The vertical orientation of the soil displacement plate 44 may vary depending upon a number of considerations such as the location along the helical plates and the radius of curvature. For example, in the configuration shown in FIGS. 4 and 5, the soil displacement plate 44 is secured to the helical plates 46 and 48 so that the soil displacement plate is substantially vertical relative to the shaft 16 of the lead 12 or the shaft 24 of the extension 14. As another example, the soil displacement plate 44 may be angled or tilted relative to the shaft 16 of the lead 12 or the shaft 24 of the extension 14.

Figure 7:
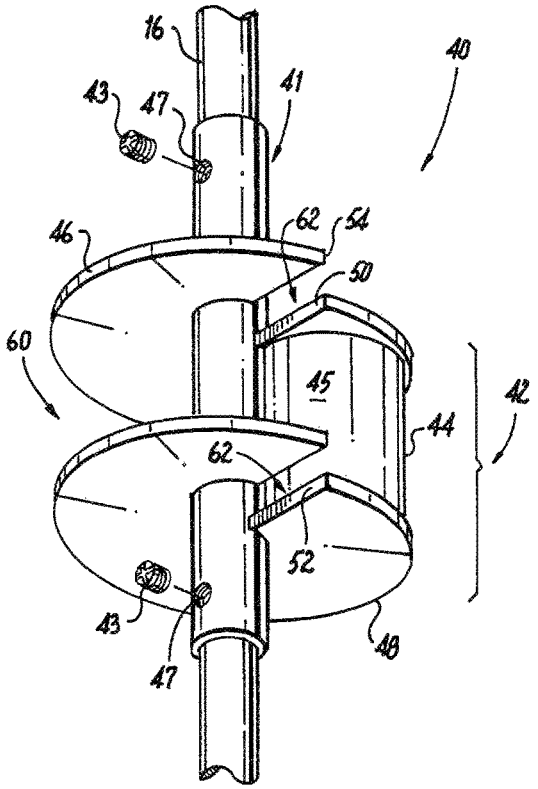
FIG. 7 is a bottom perspective view of another exemplary configuration of a soil displacement assembly according to the present disclosure.

Referring to FIG. 7, another exemplary configuration of a soil displacement assembly is shown. The soil displacement assembly 40 includes coupling tube 41, a pair of helical plates 42 and at least one soil displacement plate 44. The coupling tube 41 is configured to fit over shaft 16 of the lead 12 or the shaft 24 of the extension 14, and can be secured to the shaft 16 or 24 via a mechanical fastener, such as a set screw 43 and threaded aperture 47, that are threaded into matching threaded apertures in the respective shaft 16 or 24. Alternatively, the set screw 43 when tightened in the threaded aperture 47 on the respective shaft 16 or 24 can create a friction force between the coupling tube 41 and the shaft thus binding the soil displacement assembly 40 in position on the shaft. Each helical plate pair 42 comprises an upper helical plate 46 and a lower helical plate 48. The upper and lower helical plates 46 and 48 are secured to the coupling tube 41 by for example welding the plates to the coupling tube. The upper and lower helical plates 46 and 48 are separated by a longitudinal distance "Lp" creating a void 60 between the upper and lower helical plates. Positioned between the upper and lower helical plates 46 and 48 is the at least one soil displacement plate 44, as described above and for the ease of description is not repeated. In this exemplary configuration, the soil displacement assembly can be secured to existing helical piles to form the soil displacement pile 10 of the present disclosure.

Figure 8:
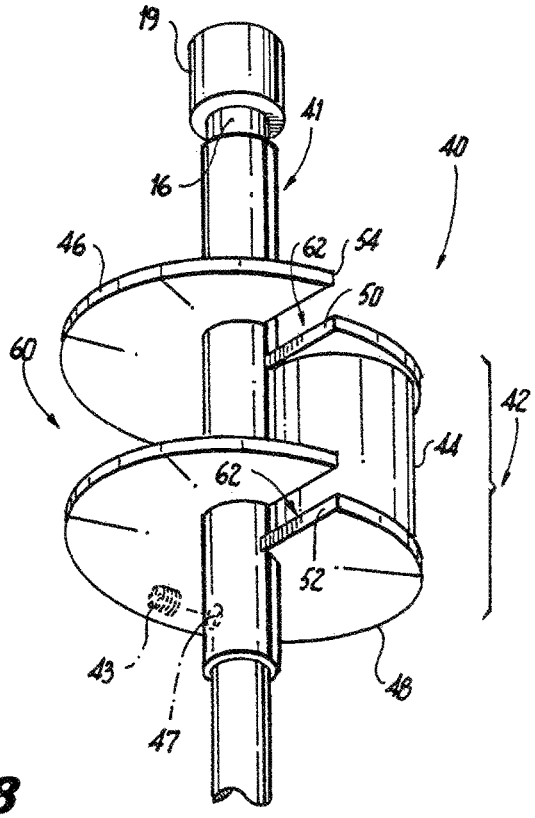
FIG. 8 is a bottom perspective view of another exemplary configuration of a soil displacement assembly according to the present disclosure.

Referring to FIG. 8, another exemplary configuration of a soil displacement assembly is shown. The soil displacement assembly 40 includes coupling tube 41, a pair of helical plates 42 and at least one soil displacement plate 44. The coupling tube 41 is configured to fit over shaft 16 of the lead 12 or the shaft 24 of the extension 14, and a coupling 19 at a top of the shaft 16 of the lead 12 or the shaft 24 of the extension 14 prevents the coupling tube 41 from separating from the shaft when the lead 16 or extension 24 is being inserted into the ground. To secure the soil displacement assembly 40 on the shaft 16 of the lead 12 or the shaft 24 of the extension 14 adjacent the coupling 19, a mechanical fastener, such as a set screw 43 and threaded aperture 47, can be used to create a friction force between the coupling tube 41 and the respective shaft 16 or 24, thus binding the soil displacement assembly 40 in position on the shaft. Similar to the configuration of FIG. 7, each helical plate pair 42 comprises an upper helical plate 46 and a lower helical plate 48. The upper and lower helical plates 46 and 48 are secured to the coupling tube 41 by for example welding the plates to the coupling tube. The upper and lower helical plates 46 and 48 are separated by a longitudinal distance "Lp" creating a void 60 between the upper and lower helical plates. Positioned between the upper and lower helical plates 46 and 48 is the at least one soil displacement plate 44, as described above and for the ease of description is not repeated. In this exemplary configuration, the soil displacement assembly can be secured to existing helical piles to form the soil displacement pile 10 of the present disclosure.

Figure 9:
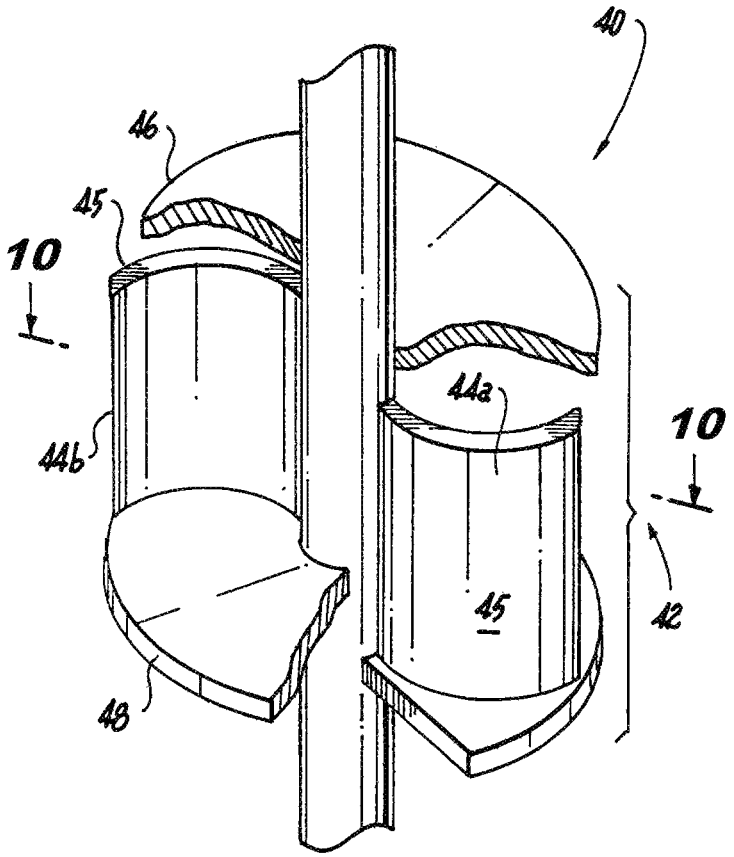
FIG. 9 is a top perspective view of another exemplary configuration of a soil displacement assembly according to the present disclosure, illustrating two soil displacing plates between the pair of helical plates.
Figure 10:
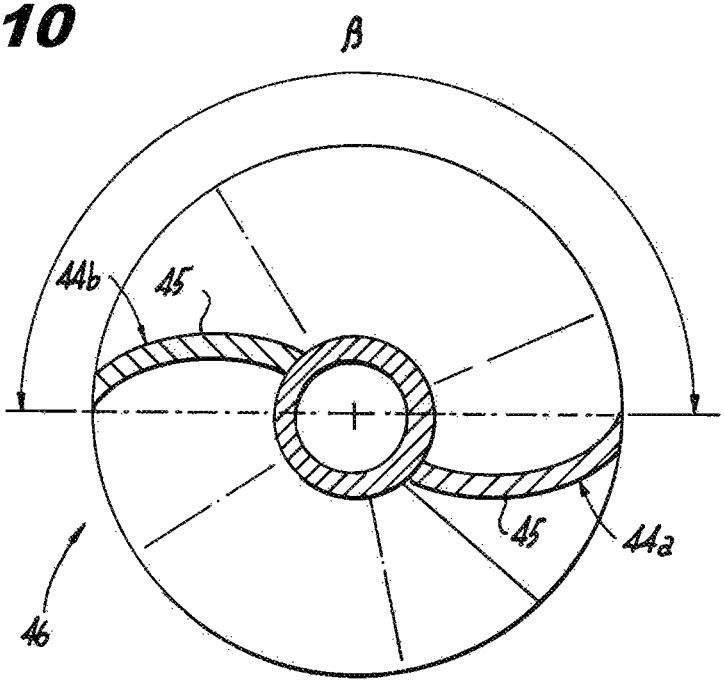
FIG. 10 is a cross-sectional view of the soil displacement assembly of FIG. 9 taken along line 10-10 and illustrating two soil displacement plates secured to a shaft and a bottom helical plate.

Referring to FIGS. 9 and 10, another exemplary configuration of a soil displacement assembly 40 is shown. In this configuration, the soil displacement assembly 40 includes two helical plates forming a pair 42 and a pair of soil displacement plates 44*a* and 44*b*. The helical plate pair 42 comprises an upper helical plate 46 and a lower helical plate 48 which are described above and for the ease of description are not repeated. In this configuration, the first soil displacement plate 44*a* is positioned the same as the soil displacement plate shown in the configuration of FIGS. 4 and 5. The second soil displacement plate 44*b* is also attached between the helical plates 46 and 48 and oriented the same as the first soil displacement plate 44*a* as shown. However, the second soil displacement plate 44*b* is attached to the helical plates at an angular distance "β" from the first soil displacement plate 44*a* as shown in FIG. 10. The angular distance "β" may be from about 60 degrees to about 180 degrees. For example, the angular distance "β" may be 180 degrees.

FIG. 11 illustrates another exemplary configuration of the soil displacement assembly according to the present disclosure. In this configuration, the soil displacement assembly 40 comprises a helical plate pair 42 where the diameter of the upper helical plate 46 and the diameter of the lower helical plate 48 differ. In the configuration shown, the upper helical plate 46 has a larger diameter than the lower helical plate 48. However, one skilled in the art would readily appreciate that the upper helical plate 46 can have a smaller diameter than the lower helical plate 48. The soil displacement plate 44 is attached between the upper helical plate 46 and the lower helical plate 48. The different diameter between the upper and lower helical plates 46 and 48 facilitates the displacement of soil and the pulling of the soil displacement pile 10 into the ground because the distance "R" between an outer edge of the larger diameter helical plate, here plate 46, and the soil displacement plate 44 permits more of the helical plate 46 to grip the soil.

FIGS. 12 and 13 illustrate another exemplary configuration of the soil displacement assembly 40 according to the present disclosure. In this configuration, the soil displacement assembly 40 includes two helical plates forming a pair 42 and a pair of soil displacement plates 44*a* and 44*b*. The helical plate pair 42 comprises an upper helical plate 46 and a lower helical plate 48 which are described above and for the ease of description are not repeated. In this configuration, the first soil displacement plate 44*a* is positioned the same as in, for example, the configurations of FIGS. 4, 5 and 6. The second soil displacement plate 44*b* is attached to the upper helical plate 46 and the shaft 16 of the lead 12 or the shaft 24 of the extension 14 near the trailing edge 54 of the upper helical plate 46. The second soil displacement plate 44*b* provides additional soil displacement further facilitating the formation of the cavity 70 in which the pile column 80, seen in FIG. 14, is formed.

Figure 14:
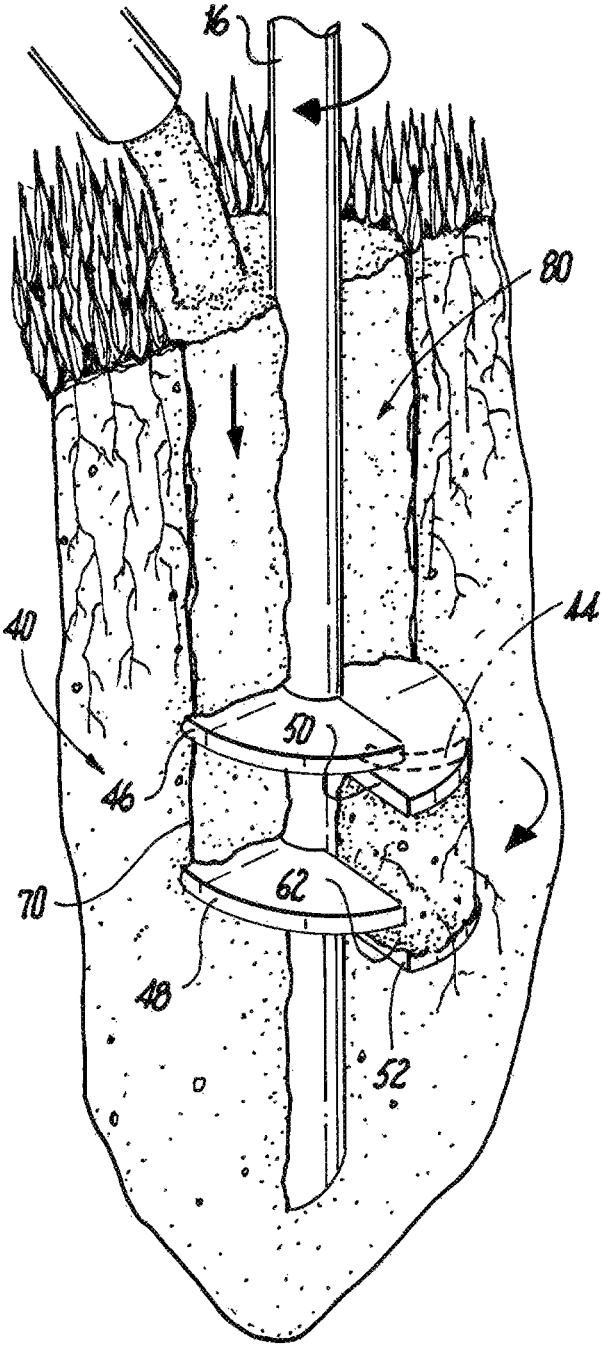
FIG. 14 is a top perspective view of the soil displacement pile lead of FIG. 1 being screwed into the soil with the soil displacement assembly creating a cavity in which filler is being poured.
Figure 15:
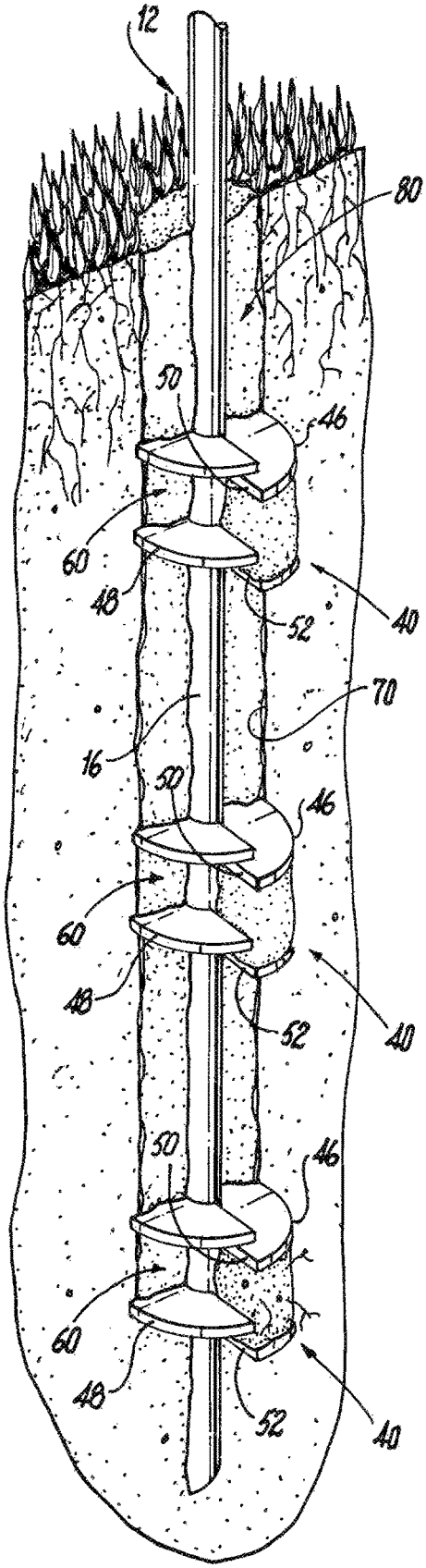
FIG. 15 is a top perspective view of the soil displacement pile lead of FIG. 14 after insertion into the soil and filled with filler to create a composite pile column.

Referring now to FIGS. 14 and 15, an example of the insertion of a lead 12 into the ground and the pouring of filler into the cavity created by the soil displacement assembly of the present disclosure will be described. Initially, as the shaft 16 of the lead 12 is rotated in a clockwise direction the leading edge 52 and outer edge of the lower helical plate 48 grips the soil to start pulling the lead 12 into the ground. As the lead 12 rotates the soil contacting surface 45 of the soil displacement plate 44 displaces the soil cut by the leading edge 52 and outer edge of the lower helical plate 48 radially outwardly away from a shaft 16 of the lead 12 to begin to form a cavity 70 in which filler is poured. The leading edge 50 and outer edge of the upper helical plate 46 then grips the soil to assist in pulling the lead 12 into the ground. The upper helical plate 46 also helps to mix any loose residual soil within the cavity 70 with the filler. The gap 62 in the helical plates 46 and 48 permits the filler being poured into the cavity to fill the void 60 between the upper and lower helical plates, and permits the filler to pass through the soil displacement assembly 40 to provide a uniform pour of the filler.

When the second soil displacement assembly 40 enters the cavity 70 the leading edge 52 and outer edge of the lower helical plate 48 grips the soil to assist in pulling the lead 12 into the ground. As the lead 12 rotates the soil contacting surface 45 of the soil displacement plate 44 displaces any soil cut by the leading edge 52 of the lower helical plate 48 radially outwardly away from a shaft 16 of the lead 12 to continue to form the cavity 70 in which filler is continued to be poured. The leading edge 50 and outer edge of the upper helical plate 46 then grips the soil to assist in pulling the lead 12 into the ground. The upper helical plate 46 also helps to mix any loose residual soil within the cavity 70 with the filler. Again, the gap 62 in the helical plates 46 and 48 permits the filler being poured into the cavity to fill the void 60 between the upper and lower helical plates 46 and 48 of the second soil displacement assembly 40, and to permit the filler pass through the soil displacement assembly to provide a uniform pour of the filler.

When the third soil displacement assembly 40 enters the cavity 70 the leading edge 52 and outer edge of the lower helical plate 48 grips the soil to assist in pulling the lead 12 into the ground. As the lead 12 rotates the soil contacting surface 45 of the soil displacement plate 44 displaces any soil cut by the leading edge 52 of the lower helical plate 48 radially outwardly away from a shaft 16 of the lead 12 to continue to form the cavity 70 in which filler is continued to be poured. The leading edge 50 and outer edge of the upper helical plate 46 then grips the soil to assist in pulling the lead 12 into the ground. The upper helical plate 46 also helps to mix any loose residual soil within the cavity with the filler. Again, the gap 62 in the helical plates 46 and 48 permits filler being poured into the cavity to fill the void 60 between the upper and lower helical plates 46 and 48 of the third soil displacement assembly 40, and permits the filler to pass through the soil displacement assembly to provide a uniform pour of the filler. When the filler cures, the filler with the embedded pile 10 form a composite pile column 80.

The present disclosure describes a way of displacing soil for the purpose of creating a pile column with an embedded soil displacement pile. The one or more helical soil displacement assemblies displace soil so that filler may be poured into a cavity created by the one or more soil displacement assemblies around the soil displacement pile forming a pile column at the job site. The soil displacement assembly of the present disclosure permits the use of larger diameter shafts and helical plates for the lead and/or extensions which facilitates displacement of more soil and results in the formation of pile columns having larger diameters and therefore improved load capacity.

The helical plate pairs can be placed close together with one or more soil displacement plates connected between the helical plate pairs. The helical plates help loosen the soil and provide strength to keep the soil displacement plate in position when screwing the soil displacement pile into the ground. By using a hollow or solid shaft as a centerpiece of the lead and extensions, and larger helical plates, the soil displacement pile of the present disclosure can displace a greater volume of soil to create larger pile columns. The lead shaft and extension shafts and helical plates provide additional stiffening to the soil displacement assemblies while the filler provides the larger diameter, skin friction, and higher load capacities.

The soil displacement pile and soil displacement assembly of the present disclosure can be adapted to form any size pile column needed for a particular job. For example, the soil displacement pile and soil displacement assembly of the present disclosure can easily form pile columns that are greater than eight inches in diameter.

While illustrative embodiments have been described and illustrated above, it should be understood that these are exemplary and are not to be considered as limiting. Additions, deletions, substitutions, and other modifications can be made without departing from the spirit or scope of the present disclosure. Accordingly, the invention is not to be considered as limited by the foregoing description.

What is claimed is:

1. A soil displacement assembly forming a portion of a pile that is intended to be driven into soil and remain in the soil to support a structural load, the soil displacement assembly comprising:

an upper helical plate having a central opening defining an inner edge portion, and an outer edge portion;

a lower helical plate having a central opening defining an inner edge portion, and an outer edge portion, the lower helical plate being independent of the upper helical plate and spaced a predefined distance from the upper helical plate along a longitudinal axis of the soil displacement assembly such that the upper and lower helical plates do not overlap; and at least one curved soil displacement plate having a first edge portion attached to the upper helical plate and a second edge portion attached to the lower helical plate such that a convex surface of the at least one curved soil displacement plate forming a soil contacting surface extends from the inner edge portions of the upper helical plate and the lower helical plate to the outer edge portions of the upper helical plate and the lower helical plate, and is oriented to contact soil when the soil displacement assembly is driven into the soil to displace the soil from the inner edge portions of the upper helical plate and the lower helical plate toward the outer edge portions of the upper helical plate and the lower helical plate so as to create a cavity in the soil.

2. The soil displacement assembly according to claim 1, wherein the at least one soil displacement plate is substantially perpendicular relative to the upper helical plate and the lower helical plate.

3. The soil displacement assembly according to claim 1, wherein the at least one soil displacement plate is positioned at an angle relative to the upper helical plate and the lower helical plate.

4. The soil displacement assembly according to claim 1, wherein the upper helical plate has a diameter in the range of between about 6 inches and about 16 inches.

5. The soil displacement assembly according to claim 1, wherein the lower helical plate has a diameter in the range of between about 6 inches and about 16 inches.

6. The soil displacement assembly according to claim 1, wherein the at least one curved soil displacement plate comprises a plurality of curved soil displacement plates.

7. The soil displacement assembly according to claim 6, wherein each of the plurality of curved soil displacement plates are spaced apart a predefined distance.

8. The soil displacement assembly according to claim 1, further comprising at least one upper soil displacement plate attached to an upper surface of the upper helical plate, wherein the at least one upper soil displacement plate is a curved plate having a convex surface forming a soil contacting surface that extends from the inner edge portion of the upper helical plate toward the outer edge portion of the upper helical plate, and is oriented to contact the soil when the soil displacement assembly is driven into the soil to displace the soil in a direction away from the inner edge portion of the upper helical plate.

9. The soil displacement assembly according to claim 8, wherein the at least one upper soil displacement plate comprises a plurality of upper soil displacement plates.

10. The soil displacement assembly according to claim 9, wherein each of the plurality of upper soil displacement plates are spaced apart a predefined radial distance.

11. A soil displacement pile comprising:

a shaft intended to be driven into soil and to remain in the soil; and at least one soil displacement assembly including:

an upper helical plate secured to the shaft;

a lower helical plate secured to the shaft, the lower helical plate being independent of the upper helical plate and separated from the upper helical plate along a longitudinal axis of the shaft such that the upper and lower helical plates do not overlap; and at least one curved soil displacement plate having a top edge attached to the upper helical plate, a bottom edge attached to the lower helical plate, and a side edge attached to the shaft such that a convex surface of the at least one curved soil displacement plate forming a soil contacting surface extends from the shaft to an outer edge portion of the upper helical plate and an outer edge portion of the lower helical plate and is oriented to contact soil when the soil displacement assembly is driven into the soil so as to displace the soil from an inner edge portion of the upper helical plate and an inner edge portion of the lower helical plate toward the outer edge portions of the upper helical plate and the lower helical plate to create a cavity in the soil surrounding the shaft.

12. The soil displacement pile according to claim 11, further comprising at least one upper soil displacement plate attached to an upper surface of the upper helical plate, wherein the at least one upper soil displacement plate is a curved plate having a convex surface forming a soil contacting surface that extends from the shaft toward the outer edge portion of the upper helical plate, and is oriented to contact soil when the soil displacement assembly is driven into the soil to displace the soil in a direction away from the shaft of the pile.

13. The soil displacement pile according to claim 12, wherein the at least one upper soil displacement plate comprises a plurality of upper soil displacement plates.

14. The soil displacement pile according to claim 13, wherein each of the plurality of upper soil displacement plates are spaced apart a predefined radial distance.

15. The soil displacement pile according to claim 11, wherein the at least one curved soil displacement plate comprises a first soil displacement plate and a second soil displacement plate, wherein the first soil displacement plate is positioned adjacent a leading edge of the upper helical plate and a leading edge of the lower helical plate, and wherein the second soil displacement plate is positioned a radial distance from the first soil displacement plate.

16. The soil displacement pile according to claim 15, wherein the radial distance is 180 degrees.

* * * * *